US010273556B2

(12) United States Patent
Kwak et al.

(10) Patent No.: US 10,273,556 B2
(45) Date of Patent: Apr. 30, 2019

(54) LIGHTWEIGHT STEEL SHEET HAVING EXCELLENT STRENGTH AND DUCTILITY AND METHOD FOR MANUFACTURING SAME

(71) Applicant: POSCO, Pohang-si Gyeongsangbuk-do (KR)

(72) Inventors: Jai-Hyun Kwak, Gwangyang-si (KR); Min-Seo Koo, Gwangyang-si (KR); Dong-Seoug Sin, Gwangyang-si (KR)

(73) Assignee: POSCO, Pohang-si, Gyeongsangbuk-do (KR)

( * ) Notice: Subject to any disclaimer, the term of this patent is extended or adjusted under 35 U.S.C. 154(b) by 348 days.

(21) Appl. No.: 15/107,555

(22) PCT Filed: Dec. 26, 2013

(86) PCT No.: PCT/KR2013/012168
§ 371 (c)(1),
(2) Date: Jun. 23, 2016

(87) PCT Pub. No.: WO2015/099223
PCT Pub. Date: Jul. 2, 2015

(65) Prior Publication Data

US 2016/0312332 A1 Oct. 27, 2016

(30) Foreign Application Priority Data

Dec. 24, 2013 (KR) ..... 10-2013-0163227

(51) Int. Cl.
*C22C 38/04* (2006.01)
*C22C 38/06* (2006.01)
(Continued)

(52) U.S. Cl.
CPC ..... *C21D 9/46* (2013.01); *C21D 3/04* (2013.01); *C21D 8/0205* (2013.01);
(Continued)

(58) Field of Classification Search
None
See application file for complete search history.

(56) References Cited

U.S. PATENT DOCUMENTS 4,865,662 A 9/1989 Zimmer et al.
6,387,192 B1 5/2002 Frommeyer et al.
(Continued)

FOREIGN PATENT DOCUMENTS

CN 101111622 A 1/2008
CN 101248203 A 8/2008
(Continued)

OTHER PUBLICATIONS

Extended European Seearch Report dated Nov. 8, 2016 issued in European Patent Application No. 13900318.0.
(Continued)

*Primary Examiner* — Deborah Yee
(74) *Attorney, Agent, or Firm* — Morgan Lewis & Bockius LLP

(57) ABSTRACT

The present invention relates to a lightweight steel sheet and a method of manufacturing the same, wherein high strength and ductility can be achieved in the lightweight steel sheet even when a small amount of carbon and manganese is added, by preventing loss of austenite due to decarburizing through inhibiting decarburization, which occurs during a heat treatment step of a steel sheet containing austenite.

7 Claims, 4 Drawing Sheets

(51) Int. Cl.

| | |
|---|---|
| ***C22C 38/60*** | (2006.01) |
| ***C22C 38/08*** | (2006.01) |
| ***C22C 38/02*** | (2006.01) |
| ***C22C 38/16*** | (2006.01) |
| ***C22C 38/00*** | (2006.01) |
| ***C21D 9/46*** | (2006.01) |
| ***C21D 8/02*** | (2006.01) |
| ***C21D 3/04*** | (2006.01) |

(52) U.S. Cl.

CPC ..... *C21D 8/0226* (2013.01); *C21D 8/0236* (2013.01); *C21D 8/0263* (2013.01); *C21D 8/0273* (2013.01); *C21D 8/0278* (2013.01); *C22C 38/00* (2013.01); *C22C 38/002* (2013.01); *C22C 38/02* (2013.01); *C22C 38/04* (2013.01); *C22C 38/06* (2013.01); *C22C 38/08* (2013.01); *C22C 38/16* (2013.01); *C22C 38/60* (2013.01); *C21D 8/02* (2013.01); *C21D 2211/001* (2013.01); *C21D 2211/005* (2013.01)

(56) References Cited

U.S. PATENT DOCUMENTS

| | | | | |
|---|---|---|---|---|
| 8,778,097 | B2 | 7/2014 | Chin et al. | |
| 2006/0179638 | A1 | 8/2006 | Engl et al. | |
| 2008/0240969 | A1 | 10/2008 | Kim et al. | |
| 2009/0165897 | A1 | 7/2009 | McEwan | |
| 2009/0297387 | A1* | 12/2009 | Chin | C21D 9/48 420/79 |
| 2013/0048150 | A1* | 2/2013 | John | C21D 6/005 148/278 |

FOREIGN PATENT DOCUMENTS

| | | | |
|---|---|---|---|
| CN | 101591751 | A | 12/2009 |
| EP | 0889144 | B1 | 7/2002 |
| EP | 2128293 | A1 | 12/2009 |
| JP | 2004-323951 | A | 11/2004 |
| JP | 2005-068549 | A | 3/2005 |
| JP | 2005-273004 | A | 10/2005 |
| JP | 2006-118000 | A | 5/2006 |
| JP | 2006-176843 | A | 7/2006 |
| JP | 2007-321168 | A | 12/2007 |
| JP | 2009-287114 | A | 12/2009 |
| JP | 2011-125904 | A | 6/2011 |
| KR | 10-2005-0084429 | A | 8/2005 |
| KR | 10-2009-0123229 | A | 12/2009 |
| KR | 10-2010-0074988 | A | 7/2010 |
| KR | 10-2011-0012367 | A | 2/2011 |
| KR | 10-2011-0027075 | A | 3/2011 |
| KR | 10-2011-0115656 | A | 10/2011 |
| KR | 10-2013-0006461 | | 1/2013 |
| KR | 10-2013-0034727 | A | 4/2013 |
| WO | 2013/034317 | A1 | 3/2013 |

OTHER PUBLICATIONS

S. S. Sohn, et al., "Effect of annealing temperature on microstructural modification and tensile properties in 0.35 C-3.5 Mn-5.8 A1 lightweight steel," SciVerse ScienceDirect, Acta Materialia, vol. 61, May 25, 2013, pp. 5050-5066.

B. F. Carpenter, et al., "Microstructural Characterization of Aluminum Passivated Stainless Steel Weldments," Microstructural Science, vol. 14, Jan. 1, 1987, pp. 137-156.

International Search Report issued in corresponding International Patent Application No. PCT/KR2013/012168, dated Sep. 29, 2014, 4 pages with English translation.

Chinese Office Action dated Feb. 15, 2017 issued in Chinese Patent Application No. 201380081867.8.

* cited by examiner

LIGHTWEIGHT STEEL SHEET HAVING EXCELLENT STRENGTH AND DUCTILITY AND METHOD FOR MANUFACTURING SAME

RELATED APPLICATIONS

This application is the U.S. National Phase under 35 U.S.C. § 371 of International Patent Application No. PCT/KR2013/012168, filed on Dec. 26, 2013, which in turn claims the benefit of Korean Patent Application No. 10-2013-0163227 filed on Dec. 24, 2013, the disclosures of which Applications are incorporated by reference herein.

TECHNICAL FIELD

The present disclosure relates to a steel sheet used as a structural member or internal and external plates of a vehicle, and more specifically, to a lightweight steel sheet having improved strength and ductility.

BACKGROUND ART

Recently, as a vehicle (for example, an electric car) using a new type of fuel has appeared, the weight of a vehicle fuel system such as a storage battery is expected to be increased in comparison to the present internal combustion engine, and therefore, the development of a lightweight material that may significantly reduce the weight of a vehicle body is being required.

As a lightweight material, use of aluminum (Al) or magnesium (Mg) is under discussion, but Al or Mg has a low degree of strength and ductility, and incurs high costs. Thus, steel is still inevitably used.

Steel has more improved strength and ductility than those of Al or Mg, and also has lower costs than those of Al or Mg. Vehicle bodies have heretofore been made lightweight by reducing the thicknesses of a high-strength, high-toughness steel, but when a high specific gravity of the steel itself does not meet the limitation of weight lightening required for vehicles, a nonferrous metal such as Al is inevitably used in the steel.

Accordingly, steel having its specific gravity reduced by primarily adding Al, a light element, is being developed. A technique of manufacturing ferritic steel in which Al of 2.0 to 10.0 wt % is added to ultra-low carbon steel and a technique of manufacturing austenitic steel in which Al of 8 wt % and manganese (Mn) of 10 to 30 wt % are added to ultra-low carbon steel have been known.

The ferritic steel has a problem in that carbon of 0.2 wt % or less and aluminum of 2.5 wt % to 10 wt % are added thereto by a means of technology (Patent Document 1) which includes carbon of 0.8 wt % to 1.2 wt %, manganese of 10 wt % to 30 wt %, and aluminum of 8 wt % to 12 wt %, rigidity and a certain degree of ductility are obtained through the control of a precipitate and a crystal texture, but tensile strength is reduced to about 400 MPa and an elongation percentage is only about 25%.

To solve this problem, a dual phase lightweight steel sheet having no ridging and having improved strength and ductility was developed by containing a large amount of residual austenite to cause transformation induced plasticity and controlling the crystal texture of ferrite (Patent Document 2).

However, when the dual phase lightweight steel sheet is reheated to hot roll a slab, or thermally treated to obtain mechanical properties, the dual phase lightweight steel sheet is decarbonized and causes a problem in that the amount of austenite is reduced along with the loss of carbon, thus decreasing strength and ductility.

Patent Document 1: Japanese Patent Laid-Open No. 2006-176843

Patent Document 2: Japanese Patent Laid-Open No. 2009-287114

DISCLOSURE

Technical Problem

An aspect of the present disclosure may provide a lightweight steel sheet, which may control decarbonization occurring in a process of thermally treating a steel sheet including austenite to prevent a loss of the austenite due to the decarbonization, thereby securing high strength and ductility even when small amounts of carbon and manganese are added to the steel sheet, and a method of manufacturing the same.

Technical Solution

According to an aspect of the present disclosure, a lightweight steel sheet having improved strength and ductility may be provided, the lightweight steel sheet including carbon (C) of 0.1 to 1.2 wt %, manganese (Mn) of 2 to 10 wt %, aluminum (Al) of 3 to 10 wt %, phosphorus (P) of 0.1 wt % or less, and sulfur (S) of 0.01 wt % or less, in which the composition of the lightweight steel sheet may include at least one selected from the group consisting of nickel (Ni) of 5.0% or less, copper (Cu) of 5.0 wt % or less, antimony (Sb) of 0.01 to 0.05 wt %, and boron (B) of 0.01 wt % or less, in which the remainder of the composition may include iron (Fe) and inevitable impurities, and in which a value of the following formula B* may satisfy from 2 to 10.

$$B^*=Ni+0.5Cu+100Sb+500B \text{ (a value of each component corresponds to wt \%)}$$

According to another aspect of the present disclosure, a method of manufacturing a lightweight steel sheet having improved strength and ductility may be provided, the method including re-heating a steel slab satisfying the composition and the formula B* at a temperature of 1,000 to 1,200° C.; hot rolling the re-heated steel slab, and finally hot rolling the re-heated steel slab at a temperature of 700° C. or more; manufacturing a hot rolled steel sheet by winding the hot rolled steel slab; and cold rolling the hot rolled steel sheet at a cold reduction ratio of 40% or more.

Advantageous Effects

According to exemplary embodiments in the present disclosure, decarbonization of a lightweight steel sheet having a dual phase structure including austenite may be effectively controlled to obtain a sufficient amount of a remaining austenite even when a small amount of an alloying element is added, and the remaining austenite and a carbide may be dispersed in a ferritic base material to reduce material anisotropy and improve strength and ductility in which a tensile strength is 700 MPa or more and an elongation percentage is 30% or more, thereby providing a cold rolled steel sheet and a coated steel sheet as well as a hot rolled steel sheet having improved moldability. Thus, a vehicle body may be made significantly lightweight.

BEST MODE FOR INVENTION

The terminology used herein describes particular embodiments only, and the present disclosure is not limited thereby.

As used herein, the singular forms "a," "an," and "the" are intended to include the plural forms as well, unless the context clearly indicates otherwise.

Hereinafter, embodiments of the present disclosure will be described as follows with reference to the attached drawings.

Figure 1:
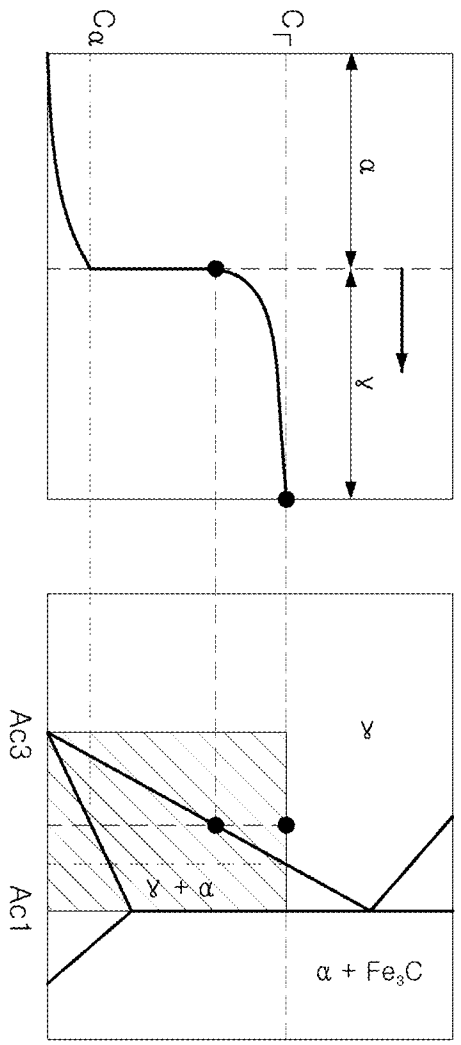
FIG. 1 is a mimetic diagram illustrating a decarbonization mechanism of a dual phase steel.

A decarbonization mechanism for a dual phase steel including austenite and ferrite is typically illustrated in FIG. 1. As illustrated in FIG. 1, when a structure of a steel includes the ferrite and the austenite, carbon (C) may react with oxygen (O) on a surface of the ferrite under a high-temperature oxidative atmosphere to form $CO_2$ or CO. The ferrite on a surface of the steel may include carbon (C) having a concentration lower than an equilibrium concentration, a concentration gradient may cause the carbon (C) to spread to the surface, and decarbonization may thus continue to be performed. However, since a concentration gradient of carbon (C) is less in the case of a single ferrite phase, a high degree of decarbonization may not be carried out.

When the austenite and the ferrite contact each other, there may be a large amount of balanced solid solution carbon in the austenite, and the ferrite may include a very small amount of balanced solid solution carbon, and the concentration gradient may thus be increased greatly. Accordingly, since a sufficient amount of carbon (C) may be supplied from the austenite and decarbonization may continue to be performed, a carbon content of the austenite which has lost carbon (C) to the ferrite may be reduced, and the austenite may thus be transformed into ferrite. Accordingly, an amount of the austenite advantageous to machinability may be reduced.

Hence, the inventors of the present disclosure recognized that the carbon (C) was actively diffused through a grain boundary, and drew a method of suppressing decarbonization such as (1) a method of reducing a grain boundary diffusion rate of carbon (C) by adding an element segregating to a grain boundary and (2) a method of preventing penetration of oxygen (O) through the grain boundary and diffusion of carbon (C) by forming an oxide on the grain boundary using a strong oxidizing element. According to an exemplary embodiment in the present disclosure, the methods of adding a grain boundary segregation element and forming an oxide on the grain boundary may effectively prevent decarbonization without a reduction in mechanical properties, whereby a low-specific gravity, lightweight steel sheet having improved strength and ductility may be manufactured with small amounts of carbon (C) and manganese (Mn) without a loss of austenite According to an exemplary embodiment in the present disclosure, a lightweight steel sheet may include carbon (C) of 0.1 to 1.2 wt %, manganese (Mn) of 2 to 10 wt %, aluminum (Al) of 3 to 10 wt %, phosphorus (P) of 0.1 wt % or less, and sulfur (S) of 0.01 wt % or less, in which the composition of the lightweight steel sheet may include at least one selected from the group consisting of nickel (Ni) of 5.0% or less, copper (Cu) of 5.0 wt % or less, antimony (Sb) of 0.01 to 0.05 wt %, and boron (B) of 0.01 wt % or less, in which the remainder of the composition may include iron (Fe) and inevitable impurities, and in which a value of the following formula B* may satisfy from 2 to 10.

$$B^*=Ni+0.5Cu+100Sb+500B \text{ (a value of each component corresponds to wt \%)}$$

The composition according to an exemplary embodiment in the present disclosure will hereinafter be described in more detail.

Carbon (C): 0.1 to 1.2 wt %

The carbon (C) included in the steel may function to stabilize the austenite, and may form cementite to provide a dispersion hardening effect. In particular, a columnar crystal formed during a continuous casting process may be quickly recrystallized to forma structure of a coarsened object during a hot rolling process, and a high-temperature carbide may thus be formed to make a microstructure. A certain amount of carbon content may be required to increase strength. According to an exemplary embodiment in the present disclosure, decarbonization may be prevented, and a large amount of carbon (C) may thus not be required, and a lowest level of the carbon (C) may be preferably determined to be 0.1 wt %.

Meanwhile, when an amount of added carbon (C) is increased, amounts of the cementite and a kappa carbide may be increased to contribute to an increase in the strength, but the ductility of the steel may be significantly reduced. In particular, in a steel including aluminum (Al), a kappa carbide may be extracted from a ferrite grain boundary to cause fragility, and an upper level of the kappa carbide may be preferably determined to be 1.2%.

Manganese (Mn): 2 to 10 wt %

The manganese (Mn) may be provided as an element that may control the characteristics of the carbide and may contribute to the formation of the austenite at high temperatures according to an exemplary embodiment in the present disclosure. The manganese (Mn) may coexist with the carbon (C) to promote extraction of the carbide at high temperatures. This may suppress a carbide on the grain boundary to control hot shortness, thereby contributing to an improvement in the strength of the lightweight steel sheet. The manganese (Mn) may also allow a lattice constant of the steel to be increased to reduce density of the steel, thereby decreasing a specific gravity of the steel. Thus, a lowest level of the manganese (Mn) may be preferably determined to be 2 wt %.

However, when a very large amount of the manganese (Mn) is added, the manganese (Mn) may steal an excessive amount of a band structure from a central segregation and the hot rolled steel sheet to reduce ductility. Therefore, an upper level of the manganese (Mn) may be preferably determined to be 10 wt %.

Aluminum (Al): 3 to 10 wt %

The aluminum (Al) according to an exemplary embodiment in the present disclosure may be a most important element along with the carbon (C) and the manganese (Mn). By adding the aluminum (Al), a specific gravity of the steel may be reduced. For this purpose, the aluminum (Al) of 3 wt % or more may be preferably added. A large amount of the aluminum (Al) may be preferably added to reduce the specific gravity, but when the large amount of the aluminum (Al) is added, an amount of an intermetal compound such as a kappa carbide, FeAl, or $Fe_3Al$ may be increased to reduce the ductility of the steel. Therefore, an upper level of the aluminum (Al) may be preferably determined to be 10 wt %.

According to an exemplary embodiment in the present disclosure, even when the contents of the carbon (C), the manganese (Mn), and the aluminum (Al) are controlled, a structural phase may preferably include the austenite at 5 area % or more thereof at high temperatures (for example, 650 to 1250° C.). When the structural phase includes the austenite at less than 5 area % thereof, a dual phase structure may not be obtained at room temperature after a steel sheet is annealed. Therefore, improved strength having a tensile strength of 700 MPa or more and enhanced ductility having an elongation percentage of 30% or more may not be obtained.

To this end, the decarbonization needs to be suppressed, and in order to control the decarbonization according to an exemplary embodiment in the present disclosure, the lightweight steel sheet may include at least one selected from the group consisting of nickel (Ni) of 5.0 wt % or less, copper (Cu) of 5.0 wt % or less, antimony (Sb) of 0.01 to 0.05 wt %, and boron (B) of 0.01 wt % or less.

The nickel (Ni) may segregate to the ferrite grain boundary to function to suppress the decarbonization and block the diffusion of the carbon (C). The nickel (Ni) may also increase stability of the austenite to improve the strength and the ductility. However, when a very large amount of the nickel (Ni) is added, a manufacturing cost of the steel may be increased, and an upper level of the nickel (Ni) may thus be preferably determined to be 5 wt % or less.

The copper (Cu) may be an element having a high degree of solid solubility in the austenite, and may form a melting film on a surface of a slab when the slab is reheated in a hot rolling process to suppress penetration of oxygen (O) and decarbonization. However, when there is a very high content of the copper (Cu), erosion of the grain boundary due to a molten copper (Cu) may cause fine cracks in the surface of the steel, resulting in a surface defect such as a scratch or a sliver on the hot rolled steel sheet. Therefore, an upper level of the copper (Cu) may be preferably determined to be 5 wt %.

The antimony (Sb) may be a grain boundary segregation element as the nickel (Ni), but may be further likely to segregate to the grain boundary than the nickel (Ni). Therefore, a small amount of the nickel (Ni) of 0.01 wt % or more may be added. According to an exemplary embodiment in the present disclosure, it was newly found that the antimony (Sb) may form a grain boundary oxide called $Mn_2Sb_2O_7$ and having ductility at high temperatures in addition to a property of the segregation to the grain boundary, and the grain boundary oxide may prevent the penetration of the oxygen (O) through the grain boundary diffusion and the diffusion of the carbon (C). However, when a large amount of the antimony (Sb) is added, an amount of the grain boundary oxide may be increased to reduce the ductility at high temperatures, resulting in edge cracks in the dual phase steel during the hot rolling process. Therefore, an upper level of the antimony (Sb) may be preferably determined to be 0.05%.

The boron (B) may be a grain boundary segregation element as the antimony (Sb), and may also be an oxide forming element. Unlike the antimony (Sb), the boron (B) may be further likely to segregate to the austenite grain boundary, and may thus have a decarbonization suppression effect less than that of the antimony (Sb). The boron (B) may have a strong tendency to form an oxide such as $B_2O_3$ on the surface of the dual phase steel as well as the grain boundary, and when a large amount of the boron (B) is added, the boron (B) may have surface flaws and cracks in the dual phase steel during the hot rolling process. Therefore, an upper level of the boron (B) may be preferably determined to be 0.01 wt %.

The remainder of the composition may include iron (Fe) and inevitable impurities.

The contents of the nickel (Ni), the copper (Cu), the antimony (Sb), and the boron (B) included in the lightweight steel sheet according to an exemplary embodiment in the present disclosure may preferably satisfy a condition in which a value defined by the following formula B* may be from 2 to 10. The formula B* may be provided to consider the mechanical properties and economic feasibility of alloys required in an exemplary embodiment in the present disclosure, and to adjust the contents of the components in order to secure an optimal decarbonization effect. In particular, when a large amount of the nickel (Ni) is added, a steel manufacturing cost may be increased, and other elements may cause surface flaws and cracks at room temperature. Therefore, it may be important to optimize the elements in consideration of these issues.

$$B^*=Ni+0.5Cu+100Sb+500B$$ (a value of each component corresponds to wt %)

When a value of the formula B* is two or more, the decarbonization suppression effect may be implemented, but when the value is greater than 10, the ductility may be reduced by a rise in an alloy cost and an increase in the amount of the grain boundary oxide. Therefore, the value may preferably not exceed 10.

The lightweight steel sheet according to an exemplary embodiment in the present disclosure may preferably include a remaining austenite in a ferrite base material. An area % of the remaining austenite may preferably be from 10 to 50%. Even when a smaller amount of an alloy element than a conventional amount of the alloy element included in the lightweight steel sheet according to an exemplary embodiment in the present disclosure is added, a sufficient amount of the remaining austenite may be secured, and a steel sheet having less material anisotropy and having improved strength having a tensile strength of 700 MPa or more and enhanced ductility having an elongation percentage of 30% or more may be provided. At this time, the steel sheet may include a cold rolled steel sheet and a coated steel sheet.

A method of manufacturing a lightweight steel sheet according to an exemplary embodiment in the present disclosure will hereinafter be described in more detail.

A steel ingot or a slab (hereinafter referred to as a slab) satisfying the composition and the value of the formula B* may be prepared, and the slab may be re-heated at a temperature of 1,000 to 1,200° C. The re-heating temperature may preferably be from 1,000 to 1,200° C. to secure a common hot rolling temperature.

After the re-heating, the slab may preferably be hot rolled, and finally rolled at a temperature of 700° C. or more. The final rolling temperature may be a temperature at which the slab may have the dual phase structure at high temperatures and may be easily rolled by ferrite having improved ductility. When the final rolling temperature is decreased, a rolling load may be increased. Therefore, the final rolling temperature may preferably be 700° C. or more.

After the hot rolling process, the slab may be wound in a common manner to manufacture a hot rolled steel sheet.

Within a temperature range of 700 to 1,200° C. at which the hot rolling process is performed, the slab may preferably include an austenite structure at an area % of 5% or more thereof. The slab may include the austenite structure at the area % of 5% or more thereof, and thus, a sufficient amount of a carbide may not be generated at a temperature at which the hot rolling process is performed, and the austenite may not be lost. Accordingly, the following cold rolled steel sheet may have high strength and ductility.

Meanwhile, when the hot rolled steel sheet remains heated at 700° C. for 30 minutes under an air atmosphere, a thickness of a decarbonized layer may preferably be 10 μm or less. After an oxidized layer is removed by grinding a surface of the hot rolled steel sheet, the hot rolled steel sheet may remain heated at 700° C. for 30 minutes under the air atmosphere, and the decarbonized layer may be measured. When the thickness of the decarbonized layer is 10 μm or less, the austenite may not be lost, and the hot rolled steel sheet may have improved strength and ductility.

In order to reduce anisotropy of the steel, a carbide and an austenite band structure with regard to the hot rolled steel sheet, the hot rolled steel sheet may be thermally treated at a temperature of 500 to 800° C. for at least one hour. The dual phase steel including an austenite structure may have a two-phase structure of soft ferrite and hard austenite, and most ferrite may be transformed during the hot rolling process. This is the reason why low strength ferrite may be restored and recrystallized very fast. Accordingly, a band structure in which a carbide or austenite are layered may be formed on a ferrite base structure. The band structure may cause mechanical property anisotropy of the steel to reduce machinability, and may be a reason for brittle fracturing during the cold rolling process. Thus, to solve this problem, the hot rolled steel sheet may preferably be thermally treated at a temperature of 500° C. or more for carbide spheroidizing, and thermally treated at a temperature of 800° C. or less for austenite band removal, for at least one hour.

In addition, the hot rolled steel sheet may be cold rolled at a cold reduction ratio of 40% or more to manufacture a cold rolled steel sheet. The cold rolling process may be commonly performed after pickling, and only when the cold reduction ratio is 40% or more, the cold rolling process may allow stored energy to be secured, and a new recrystallized structure to be obtained.

Rolling oil on a surface of the cold rolled steel sheet may be removed, and the cold rolled steel sheet may continue to be annealed, or may be plated to manufacture a coated steel sheet.

It may be desirable that the cold rolled steel sheet is heated at a heating rate of 1 to 20° C./s, is annealed at a temperature between a recrystallization temperature and a temperature of 900° C. or less for 10 to 180 seconds, and is then cooled up to 400° C. at a cooling rate of 1 to 100° C./s during the continuous annealing process.

When the heating rate is less than 1° C./s, productivity may be reduced, and the cold rolled steel sheet may be exposed to high temperatures for a long period of time to receive coarsening and a reduction in strength, thereby decreasing quality. When the heating rate is greater than 20° C./s, the carbide may be unsatisfactorily re-dissolved to reduce an amount of formed austenite, thereby reducing an amount of a remaining austenite, resulting in a reduction in ductility.

The cold rolled steel sheet may preferably remain heated at the temperature between a recrystallization temperature and a temperature of 900° C. or less for 10 seconds or more to be cracked in such a manner that a sufficient degree of recrystallization and crystal grain growth may be performed. When the cold rolled steel sheet is annealed for more than 180 seconds, productivity may be reduced, and zinc plating bath and alloying times may be increased in the following plating process, thereby causing concern that corrosion resistance and surface properties may deteriorate.

Meanwhile, the plating is not particularly limited, and zinc-based plating, aluminum-based plating, or metal alloy plating may be applied to secure the corrosion resistance. For example, a plating layer such as Zn, Zn—Fe, Zn—Al, Zn—Mg, Zn—Al—Mg, Al—Si, or Al—Mg—Si may be formed. The plating layer may preferably be formed to have a thickness of 10 to 200 μm for each side in terms of securing a sufficient degree of corrosion resistance.

MODE FOR INVENTION

Exemplary embodiments in the present disclosure will hereinafter be described in more detail. The following exemplary embodiments are only examples for a better understanding of the present disclosure, and the scope of the present disclosure is not limited thereto.

Example

A slab having a composition listed on Table 1 below may be manufactured, may be re-heated at 1150° C., and may be finally hot rolled within a temperature range of 750 to 850° C. At this time, a thickness of a hot rolled steel sheet may be 3.2 mm, and the hot rolled steel sheet may remain heated at a temperature of 500 to 700° C. for one hour, and may be cooled at room temperature. Then, scales of a surface of the hot rolled steel sheet may be removed, and carbide spheroidizing and austenite band removal may be performed at 700° C. for 5 hours, thereby manufacturing a cold rolled steel sheet having a thickness of 1.0 mm.

TABLE 1

| Division | C | Mn | P | S | Al | Ni | Cu | Sb | B | B* |
|---|---|---|---|---|---|---|---|---|---|---|
| Inventive Example 1 | 0.12 | 9.9 | 0.011 | 0.007 | 3.3 | 4.7 | — | 0.02 | — | 6.7 |
| Inventive Example 2 | 1 | 2.2 | 0.009 | 0.005 | 9.8 | 4.5 | — | 0.05 | — | 9.5 |
| Inventive Example 3 | 0.5 | 6.1 | 0.011 | 0.003 | 6.1 | — | — | — | 0.005 | 2.5 |
| Inventive | 0.32 | 3.5 | 0.012 | 0.004 | 6.2 | — | — | 0.03 | — | 3 |

TABLE 1-continued

| Division | C | Mn | P | S | Al | Ni | Cu | Sb | B | B* |
|---|---|---|---|---|---|---|---|---|---|---|
| Example 4 | | | | | | | | | | |
| Inventive Example 5 | 0.31 | 8.2 | 0.011 | 0.005 | 4.8 | — | 4.8 | — | — | 2.4 |
| Inventive Example 6 | 0.6 | 2.5 | 0.012 | 0.004 | 7.6 | 0.9 | 0.5 | 0.01 | — | 2.15 |
| Comparative Example 1 | 0.004 | 0.24 | 0.011 | 0.003 | 3.5 | — | — | 0.04 | — | 4 |
| Comparative Example 2 | 1.2 | 2.7 | 0.011 | 0.006 | 8.7 | — | — | — | 0.002 | 1 |
| Comparative Example 3 | 0.5 | 7.2 | 0.01 | 0.004 | 5.8 | 1.6 | — | — | — | 1.6 |
| Comparative Example 4 | 0.3 | 3.5 | 0.012 | 0.004 | 6.2 | — | — | — | — | 0 |
| Comparative Example 5 | 0.32 | 3.5 | 0.012 | 0.004 | 9.0 | 6.0 | — | — | 0.01 | 11.0 |

On Table 1 above, units of the components may be wt %, and the remainder of the composition may iron (Fe) and inevitable impurities. In addition, B* may define Ni+0.5Cu+100Sb+500B.

The cold rolled steel sheet may be heated up to 800° C. at a heating rate of 5° C./s to remain heated at 800° C. for 60 seconds, may then be slow cooled at a temperature of 600 to 680° C., may be fast cooled up to 400° C. at a cooling rate of 20° C./s to remain at a constant temperature for 100 seconds, and may be galvanized in a molten zinc plating bath having a temperature of 400 to 500° C., thereby manufacturing a galvanized steel sheet.

Table 2 below shows estimated physical properties of the manufactured galvanized steel sheet. In order to measure an austenite percentage of the slab at 1000° C. listed on Table 2 below, respective hot rolled steel sheets may remain in a furnace preheated at 1000° C. for one hour, and may be water cooled. The austenite percentage may be measured as percentages of remaining phases except ferrite.

TABLE 2

| Division | Austenite percentage (%) at 1000° C. | Decarbonized layer depth (μm) | Remaining austenite percentage (%) | Tensile strength (MPa) | Elongation percentage (%) |
|---|---|---|---|---|---|
| Inventive Example 1 | 87 | 3 | 50 | 1064 | 31.3 |
| Inventive Example 2 | 26 | 1 | 25 | 998 | 38.4 |
| Inventive Example 3 | 32 | 6 | 31 | 884 | 35.8 |
| Inventive Example 4 | 25 | 7 | 23 | 798 | 32.1 |
| Inventive Example 5 | 55 | 8 | 35 | 837 | 34.6 |
| Inventive Example 6 | 12 | 9 | 12 | 881 | 37.5 |
| Comparative Example 1 | 0 | 0 | 0 | 426 | 21.1 |
| Comparative Example 2 | 46 | 20 | 12 | 742 | 22.2 |
| Comparative Example 3 | 42 | 16 | 16 | 803 | 27.6 |
| Comparative Example 4 | 16 | 170 | 5 | 756 | 26.4 |
| Comparative Example 5 | 45 | 1 | 33 | — | — |

As shown in Table 2 above, it can be seen that little austenite was lost in the case of the Inventive Examples, whereas much austenite was lost in the case of the Comparative Examples, and the required tensile strengths and elongation percentages of a final lightweight steel sheet according to the present disclosure were not satisfied.

Meanwhile, in the case of Comparative Example 5, it was impossible to manufacture a cold rolled annealed sample, and this was the reason why a large amount of $B_2O_3$ was extracted from the grain boundary in the hot rolling process to provide a decarbonization suppression effect, but brittle fracturing occurred in the cold rolling process.

Figure 2A:
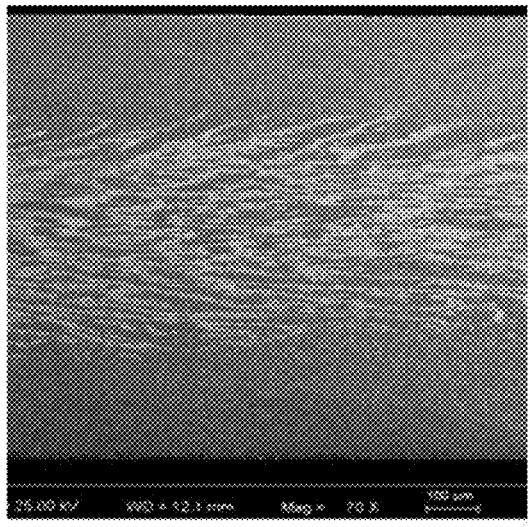
FIG. 2A is a structure photograph of a hot rolled steel sheet of Comparative Example 4 after the hot rolled steel sheet remains heated at 700° C. for 30 minutes.
Figure 2B:
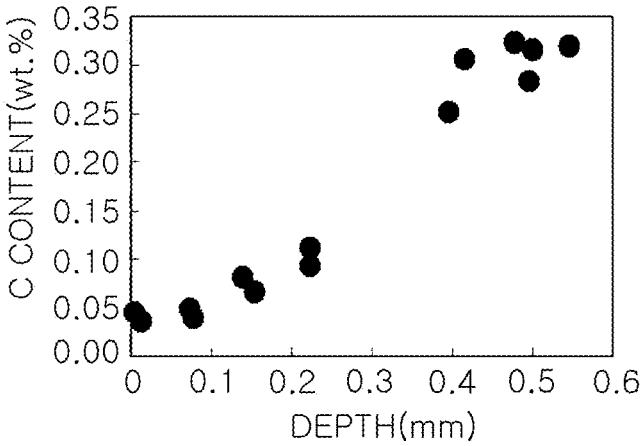
FIG. 2B is a carbon concentration distribution of the hot rolled steel sheet of Comparative Example 4 after the hot rolled steel sheet remains heated at 700° C. for 30 minutes.

Meanwhile, FIGS. 2A and 2B illustrate a structure photograph and a carbon concentration distribution of a hot rolled steel sheet of Comparative Example 4 after the hot rolled steel sheet remains heated at 700° C. under an air atmosphere for 30 minutes, respectively. The hot rolled steel sheet of Comparative Example 4 was significantly decarbonized in advance. In order to fully remove the decarbonized layer, the hot rolled steel sheet was grinded to a 1.2 mm thickness, and remained in a furnace preheated at 700° C. under the air atmosphere for 30 minutes. A structure of the hot rolled steel sheet was measured with a scanning electron microscope (SEM). It can be seen that an average depth of the decarbonized layer seemed to be 170 μm on the structure photograph, but as a result of a concentration of carbon (C) estimated from a surface of the decarbonized layer, the surface was deeply decarbonized up to about 400 μm. Accordingly, it can be estimated that a considerable amount of the remaining austenite may be lost up to about 400 μm to reduce ductility, and austenite having a low carbon (C) content had low thermal stability, thereby being transformed into ferrite including martensite or a carbide while being cooled to room temperature.

FIG. 3 is a structure photograph in which the hot rolled steel sheets of Inventive Example 4 and Comparative Example 4 remain heated at 700° C. under the air atmosphere for 30 minutes and decarbonization of surfaces thereof is observed.

Figure 3A:
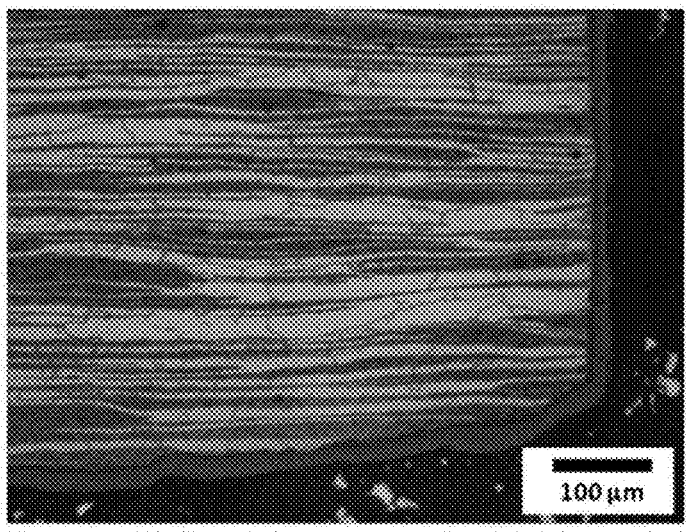
FIG. 3A is a structure photograph of a hot rolled steel sheet of Inventive Example 4.
Figure 3B:
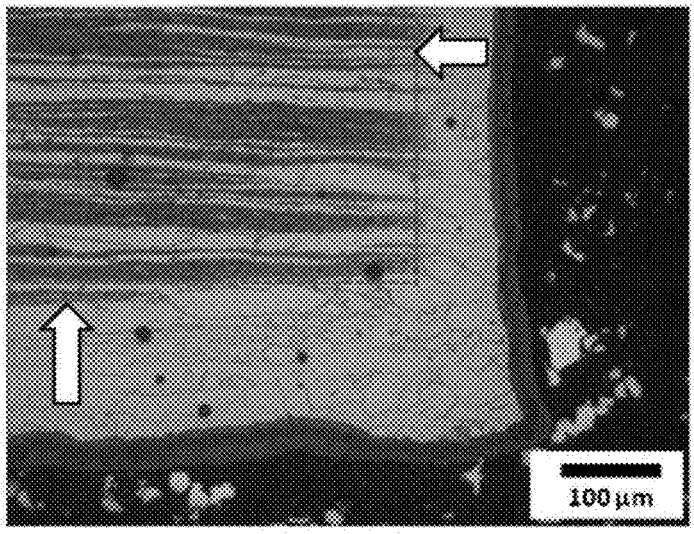
FIG. 3B is a structure photograph of the hot rolled steel sheet of Comparative Example 4.

It can be seen that the hot rolled steel sheet of Inventive Example 4 illustrated in FIG. 3A may not be hardly decarbonized at a depth of 7 μm, a larger amount of stabilized austenite may remain up to room temperature, and the hot rolled steel sheet may thus have improved strength and ductility, but it can be seen that the hot rolled steel sheet of Comparative Example 4 illustrated in FIG. 3B was significantly decarbonized at a depth of 170 μm.

Figure 4A:
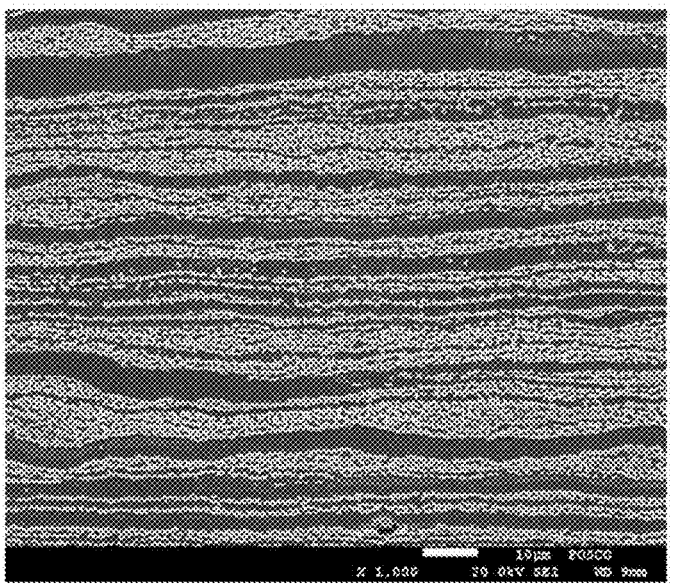
FIG. 4A is a structure photograph of the hot rolled steel sheet of Inventive Example 4 before the hot rolled steel sheet is thermally treated before a cold rolling process.
Figure 4B:
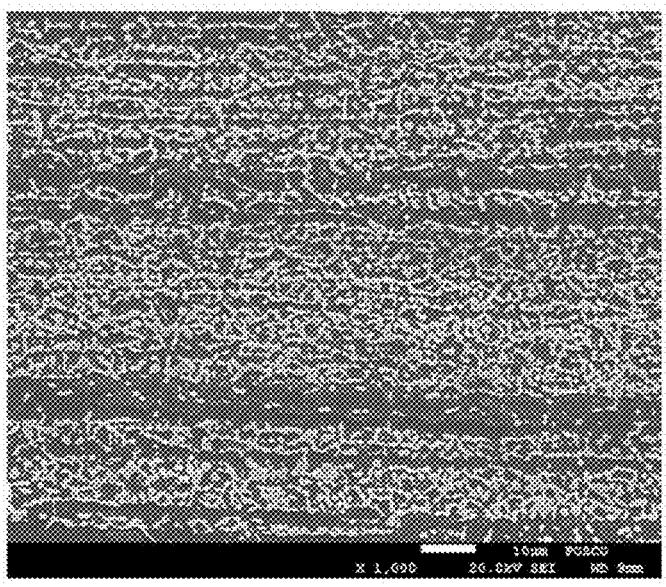
FIG. 4B is a structure photograph of the hot rolled steel sheet of Inventive Example 4 after the hot rolled steel sheet is thermally treated before the cold rolling process.

FIG. 4A is a structure photograph of the hot rolled steel sheet of Example 4 before the hot rolled steel sheet is thermally treated before a cold rolling process. FIG. 4B is a structure photograph of the hot rolled steel sheet of Example 4 after the hot rolled steel sheet is thermally treated before the cold rolling process.

The hot rolled steel sheet of Inventive Example 4 may be pickled to remove an oxide formed on a surface thereof, and carbide spheroidizing and austenite band removal may be performed by a thermal treatment at 700° C. for 5 hours. The hot rolled steel sheet of Inventive Example 4 may have a decarbonization suppression effect, thereby being subjected to such a thermal treatment. The hot rolled steel sheet was cold rolled to 67% thereof, was heated up to 800° C. to be cracked for 60 seconds, and was annealed. A microstructure of the hot rolled steel sheet was observed with the scanning electron microscope (SEM).

FIG. 4A illustrates a microstructure of the hot rolled steel sheet before the thermal treatment thereof. The dual phase steel may have a two-phase structure of soft ferrite and hard austenite within a hot rolling temperature range, and most ferrite may be transformed during the hot rolling process. This is the reason why low strength ferrite may be restored and recrystallized very fast. Accordingly, a band structure in which a carbide or austenite are layered may be formed on a ferrite base structure. Such a band structure may cause mechanical property anisotropy of the steel to reduce machinability, and may be a reason for brittle fracturing during the cold rolling process.

Conversely, it can be seen that a thermally treated microstructure illustrated in FIG. 4B may include a remaining austenite relatively uniformly distributed therein. This effect may be obtained only when the decarbonization is suppressed as in the present disclosure. When there is no decarbonization suppression effect, the decarbonization may reduce stability of the austenite during the thermal treatment for the carbide spheroidizing at 700° C., and the austenite may be lost, thereby significantly reducing strength and ductility.

Thus, the present disclosure may have an advantage to the elimination of a loss of the austenite even in the thermal treatment for the carbide spheroidizing and for a reduction in the austenite band structure through control of the decarbonization, thereby manufacturing a high-ductility, low-specific gravity lightweight steel sheet having anisotropy much less than that of the related art.

The invention claimed is:

1. A lightweight steel sheet having improved strength and ductility comprising:

carbon (C) of 0.1 to 1.2 wt %, manganese (Mn) of 2 to 10 wt %, aluminum (Al) of 3 to 10 wt %, phosphorus (P) of 0.1 wt % or less, and sulfur (S) of 0.01 wt % or less, wherein the composition of the lightweight steel sheet comprises at least one selected from the group consisting of nickel (Ni) of 5.0% or less, copper (Cu) of 5.0 wt % or less, antimony (Sb) of 0.01 to 0.05 wt %, and boron (B) of 0.01 wt % or less, wherein the remainder of the composition comprises iron (Fe) and impurities, wherein a value of the following formula B* satisfies from 2 to 10

$$B^*=Ni+0.5Cu+100Sb+500B \text{ (a value of each component corresponds to wt \%)}, \text{ and}$$

wherein a microstructure of the light weight steel sheet comprises 31 to 50 area % of a remaining austenite added to a ferritic base structure.

2. The lightweight steel sheet having improved strength and ductility of claim 1, wherein tensile strength of the lightweight steel sheet is 700 MPa or more, and an elongation percentage of the lightweight steel sheet is 30% or more.

3. A method of manufacturing a lightweight steel sheet having improved strength and ductility comprising:

re-heating a steel slab at a temperature of 1,000 to 1,200° C., the steel slab comprising carbon (C) of 0.1 to 1.2 wt %, manganese (Mn) of 2 to 10 wt %, aluminum (Al) of 3 to 10 wt %, phosphorus (P) of 0.1 wt % or less, and sulfur (S) of 0.01 wt % or less, wherein the composition of the steel slab comprises at least one selected from the group consisting of nickel (Ni) of 5.0% or less, copper (Cu) of 5.0 wt % or less, antimony (Sb) of 0.01 to 0.05 wt %, and boron (B) of 0.01 wt % or less, wherein the remainder of the composition comprises iron (Fe) and impurities, and wherein a value of the following formula B* satisfies from 2 to 10, $$B^*=Ni+0.5Cu+100Sb+500B \text{ (a value of each component corresponds to wt \%)};$$

hot rolling the re-heated steel slab, and finally hot rolling the re-heated steel slab at a temperature of 700° C. or more;

manufacturing a hot rolled steel sheet by winding the hot rolled steel slab;

cold rolling the hot rolled steel sheet at a cold reducing rate of 40% or more, wherein when the hot rolled steel sheet remains heated at a temperature of 700° C. for 30 minutes under an air atmosphere, a thickness of a decarbonization layer is 10 μm or less.

4. The method of claim 3, wherein a microstructure of the steel slab during the hot rolling thereof comprises austenite at a surface integral ratio of 5% or more.

5. The method of claim 3, wherein the hot rolled steel sheet is subjected to thermal treatment at a temperature of 500 to 800° C. for at least one hour.

6. The method of claim 3, wherein the cold rolled steel sheet is heated from a recrystallization temperature to a temperature of 900° C. at a heating rate of 1 to 20° C./s, remains heated for 10 to 180 seconds, and is cooled at a cooling rate of 1 to 100° C./s.

7. The method of claim 3, further comprising forming a coating layer including one selected from Zn, Zn—Fe, Zn—Al, Zn—Mg, Zn—Al—Mg, Al—Si, and Al—Mg—Si.

* * * * *